US009170037B2

(12) United States Patent
LeBlanc et al.

(10) Patent No.: US 9,170,037 B2
(45) Date of Patent: Oct. 27, 2015

(54) AIR CONDITIONER CONDENSING UNIT FOR CORROSIVE ENVIRONMENTS

(71) Applicants: Mervyn LeBlanc, Houma, LA (US); Scott Berniard, Houma, LA (US)

(72) Inventors: Mervyn LeBlanc, Houma, LA (US); Scott Berniard, Houma, LA (US)

(73) Assignee: LEBLANC And Associates, Inc, Houma, LA (US)

( * ) Notice: Subject to any disclaimer, the term of this patent is extended or adjusted under 35 U.S.C. 154(b) by 121 days.

(21) Appl. No.: 14/053,530

(22) Filed: Oct. 14, 2013

(65) Prior Publication Data

US 2015/0101360 A1 Apr. 16, 2015

(51) Int. Cl.

| | |
|---|---|
| ***F25B 39/04*** | (2006.01) |
| ***F24F 1/14*** | (2011.01) |
| *B63J 2/00* | (2006.01) |

(52) U.S. Cl.

CPC . *F25B 39/04* (2013.01); *F24F 1/14* (2013.01); *B63J 2/00* (2013.01)

(58) Field of Classification Search

CPC ..... F25B 39/04; F25B 2339/04; F25B 2339/047; F25B 2347/00; F25B 2505/05; F25B 2339/00; F24F 1/14; F28F 19/00; B63J 2/00

USPC ..... 62/428, 240, 285, 503, 426, 498, 259.1

See application file for complete search history.

(56) References Cited

U.S. PATENT DOCUMENTS

| | | | | | |
|---|---|---|---|---|---|
| 3,898,865 | A * | 8/1975 | Stewart et al. | ..... | 62/280 |
| 4,723,419 | A * | 2/1988 | Kessler et al. | ..... | 62/507 |
| 5,117,649 | A * | 6/1992 | Mangini et al. | ..... | 62/251 |
| 5,848,536 | A * | 12/1998 | Dodge et al. | ..... | 62/240 |
| 6,070,424 | A * | 6/2000 | Bauman et al. | ..... | 62/279 |
| 6,318,108 | B1 * | 11/2001 | Holstein et al. | ..... | 62/279 |
| 6,519,970 | B1 * | 2/2003 | Rafalovich et al. | ..... | 62/448 |
| 6,666,038 | B1 * | 12/2003 | Hynes | ..... | 62/171 |
| 6,871,507 | B1 * | 3/2005 | Goldsmith | ..... | 62/183 |
| 7,263,852 | B2 * | 9/2007 | Bacchus | ..... | 62/305 |
| 7,269,966 | B2 * | 9/2007 | Lowenstein et al. | ..... | 62/271 |
| 2003/0217563 | A1 * | 11/2003 | Wendt et al. | ..... | 62/298 |
| 2007/0245765 | A1 * | 10/2007 | Casher | ..... | 62/389 |

* cited by examiner

*Primary Examiner* — Mohammad M Ali

(74) *Attorney, Agent, or Firm* — Henry E. Naylor

(57) ABSTRACT

An improved air conditioner condensing unit for use in corrosive environments, particularly salt water environments. The condensing unit comprises a compressor, a condenser coil comprised of refrigerant carrying tubing, which tubing contains from about 8 to about 19 fins per linear inch of tubing, and a motorized corrosive resistant shrouded fan assembly, all of which are contained in a substantially corrosion resistant housing.

13 Claims, 6 Drawing Sheets

REAR VIEW

AIR CONDITIONER CONDENSING UNIT FOR CORROSIVE ENVIRONMENTS

CROSS-REFERENCE TO RELATED APPLICATIONS

This application is a Continuation-in-Part of U.S. Ser. No. 12/589,001 filed Oct. 16, 2009 which was based on Provisional Application 61/197,207 filed Oct. 24, 2008.

FIELD OF THE INVENTION

The present invention relates to an improved air conditioner condensing unit for use in corrosive environments, particularly salt water environments. The condensing unit comprises a compressor, a condenser coil comprised of refrigerant carrying tubing, which tubing contains from about 8 to about 19 fins per linear inch of tubing, and a motorized corrosive resistant shrouded fan assembly, all of which are contained in a substantially corrosion resistant housing.

BACKGROUND OF THE INVENTION

Corrosive environments present a significant problem for equipment such as air conditioning equipment. One such corrosive environment is a marine environment. Marine air conditioning equipment is subjected to significantly harsher environments when compared to air conditioning equipment designed and used in non-corrosive environments. For example, one problem associated with air conditioning equipment used on boats, such as offshore supply boats and crew boats serving the oil industry, is rapid deterioration of the condenser coil. It is common that the fins of conventional condenser coils become plugged owing to such things as salt corrosion, chemical dust resulting from the transportation of various chemical cargos, as well as other extraneous particulate matter. Salt water corrosion significantly shortens the service life of the marine equipment.

Further, many sea-going vessels are now required to have an on-board working firefighting system. Such a system is typically tested once a month which involves spraying the entire exterior of the vessel with saltwater. This leads to accelerated corrosion of deck equipment.

There is a wide variety of marine air conditioning equipment on the commercial market, but they all are all faced with premature failure owing to the above mentioned problems. Several approaches have been taken to improve marine air conditioning equipment. For example, U.S. Pat. No. 5,848,536 teaches a self contained marine air conditioner whose operative components are mounted in a deep condensate pan with the condenser coil within the same shroud as the evaporator coil and between the evaporator coil and the blower. A decontamination system for a marine air conditioner is taught in U.S. Pat. No. 7,278,272 wherein a germicidal lamp, which preferably emits ultraviolet radiation is provided upstream of the evaporator coil.

While there are various commercial marine air conditioning units on the market today, most of them suffer from premature failure due to harsh corrosive environments. Therefore, there is a need in the art for air conditioner equipment that can better withstand harsh corrosive environments compared to conventional air conditioner equipment on the market today.

SUMMARY OF THE INVENTION

In accordance with the present invention, there is provided a condensing unit for use with an air conditioning system, the condensing unit is associated with a marine vessel and is resistant to salt water corrosion, the condensing unit is comprised of:

a) a housing comprised of a corrosion resistant substantially flat baseplate having a first end and a second end and containing at least one drain hole, two corrosion resistant opposing side panels, a corrosion resistant top panel and a corrosion resistant rear panel, which rear panel contains a discharge port extending into the interior of the condensing unit and forming a shroud;

b) a condenser coil assembly coated with a material that is resistant to corrosion with respect to a salt water environment and operatively secured to said first end of said baseplate, the condenser coil assembly being comprised of opposing vertically disposed header plates through which horizontally disposed refrigerant carrying tubes extend across the width of said condenser coil assembly and wherein the ends of said tubes are interconnected by return tube bends to form a continuous loop, and wherein there is provided a plurality of vertically disposed metallic fins penetrated by said horizontally disposed tubes wherein the number of fins per linear inch is from 8 to 19 to mitigate plugging between fins;

c) a fan assembly comprised of a fan blade and a fan motor for rotating said fan blade, wherein the fan assembly is secured at said second end of said baseplate by use of a supporting bracket that is secured to the rear panel of said condenser unit and to which said fan motor is attached, wherein the fan assembly and condenser coil assembly are oriented so that a stream of air is drawn through said condenser coil assembly by operation of said fan blade and discharged horizontally with respect to the deck of a marine vessel through said discharge port at the rear panel;

d) a corrosion resistant shroud surrounding said fan assembly, wherein there is a gap between the outermost edge of said fan blade and the interior wall of said shroud, which gap is between about 0.100 inch to 0.900 inch;

e) a compressor operatively connected to said condenser coil and positioned between said fan assembly and said condenser coil assembly, which compressor is capable of compressing and moving a refrigerant through said condenser coil; and f) a corrosive resistant substantially water tight electrical enclosure wherein the main power, controller connections, and electrical components of said condensing unit are connected.

In a preferred embodiment, the number of fins per linear inch is from about 10 to 18.

In another preferred embodiment, the baseplate and condenser housing is comprised of a stainless steel In another preferred embodiment there is also present a sacrificial anode on a line leading to or leading from the compressor.

DETAILED DESCRIPTION OF THE INVENTION

The condensing unit of the present invention is suitable for use as a component of an air conditioning system used on a stationary or mobile structure in a corrosive environment, preferably a marine environment. By "marine environment" we mean on or about a body of water, preferably salt water, such as bays, seas and oceans. Non-limiting examples of preferred stationary structures on which the condensing unit of the present invention can be used include industrial plants and petroleum drilling and production platforms. Non-limiting examples of preferred mobile structures on which the condensing unit of the present invention can be used include marine vessels such as boats and ships, preferably those used to transport personnel and supplies to offshore drilling and production platforms. Pleasure boats and cruise ships are also examples of mobile marine structures on which the condensing unit of the present invention can be used.

As previously mentioned, it is notoriously known that a marine environment is a harsh environment with respect to a wide variety of equipment, particularly equipment that is located on an open deck of a marine vessel and that contains components that are subject to corrosion in a salt water environment. The condensing unit of the present invention, which is used as part of a marine air conditioning system, overcomes many of the shortcomings of conventional marine air conditioning systems. For example, the condensing unit of the present invention is substantially more corrosion resistant compared to conventional marine condensing units, which are typically residential units which are normally not subjected to a corrosive environment. The condenser coil assembly of the present invention is also substantially more resistant to plugging and fouling, primarily because of the larger diameter tubing size used and the wider gap between condenser coil fins.

Figure 1:
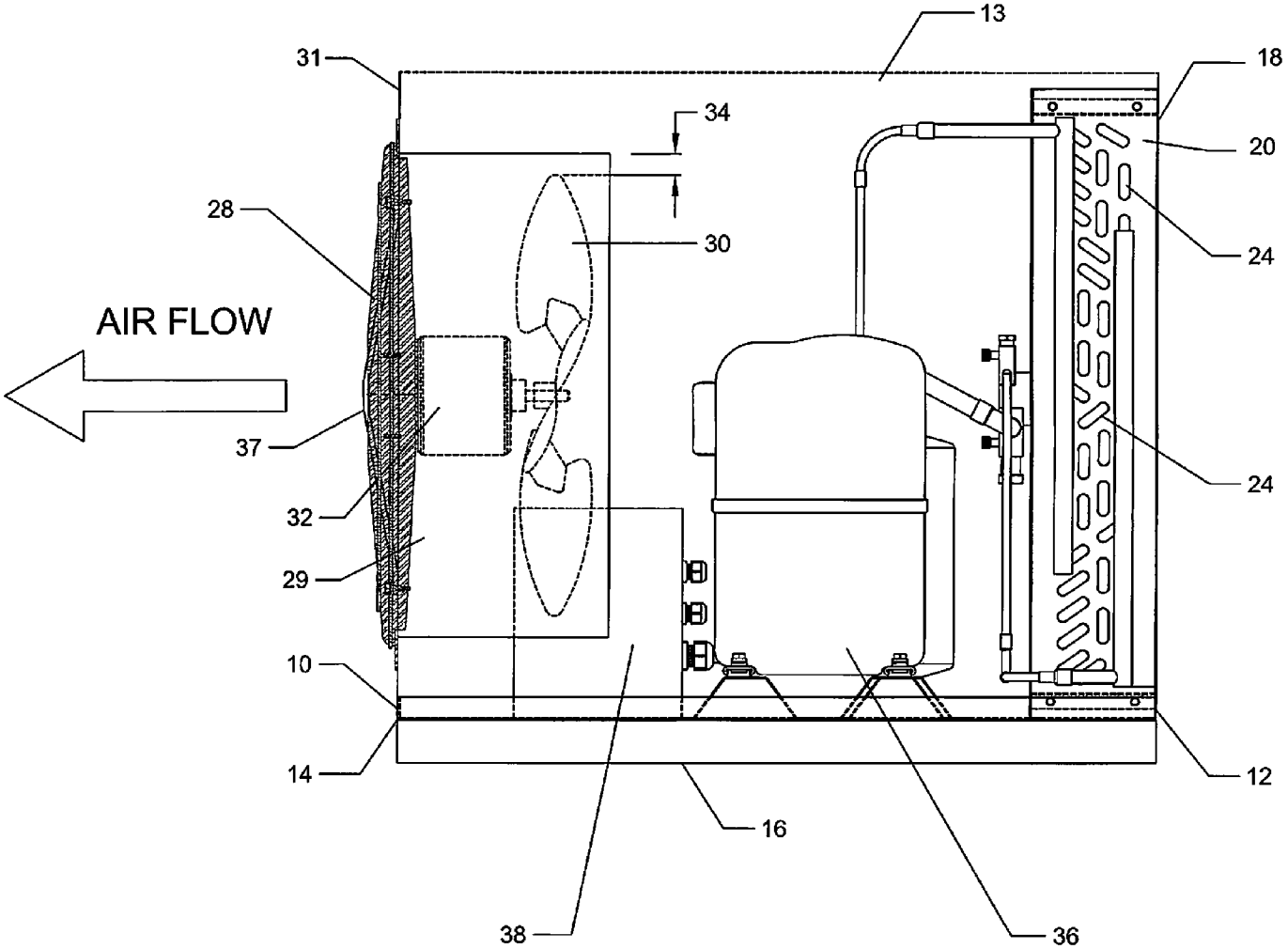
FIG. 1 hereof is a side view showing the main components of the condensing unit of the present invention.

The present invention will be better understood with reference to the figures hereof. FIG. 1 hereof is a representation of a side view of a preferred condensing unit of the present invention with its' side panel removed. It will be understood that the condensing unit of the present invention will have opposing corrosion resistant side panels as well as a corrosion resistant top panel. One or both of the side panels will contain one or more ports to allow for the appropriate tubing and wiring needed for the condensing unit to perform its' intended purpose. The condensing unit is comprised of a base plate 10 which can be of any suitable substantially flat geometric shape. It is preferred that it be rectangular in shape, having a first end 12 and a second end 14 with two opposing sides. There is also provided a top panel or plate 13 comprised of a corrosion resistant material, preferably stainless steel sheet metal. Conventional condensing units typically have their components mounted to a baseplate that has been pressed from a single sheet of metal that serves to strengthen the base. During the pressing process, mounting locations for the various condensing unit components are also pressed into the base, thereby leaving indentations in the base which often act as water reservoirs. These reservoirs have a tendency to retain corrosive material such as salt and other corrosive chemicals, that can lead to deterioration and premature failure of the base plate as well as being a hazard for personnel. The base plate of the condensing unit of the present invention is substantially flat and contains no such indentations. Holes are drilled, or punched, through the base plates of the present invention to allow drainage of liquids and to provide places where the various components are secured to the base plate. It is preferred that the base plates of the present invention be made of a corrosion resistant material such as carbon fiber reinforced polymeric materials and stainless steels. Stainless steels are preferred with 316 grade stainless steel being more preferred. 316 grade stainless steel typically contains from about 16 wt. % to 18 wt. % chromium. It is also preferred that all mounting hardware, such as screws, nuts and bolts also be made of a corrosive resistant material, preferably a stainless steel.

The base plate of the present invention is preferably reinforced by use of a plurality, preferably three, runners 16 that run from the front to the back of said base plate. Runners 16 are of a predetermined height of from about 0.5 to 3, preferably from about 0.5 to 2 inches to raise the condensing unit above a lower stacked condensing unit or mounting foundation to allow water can drain.

Figure 2:
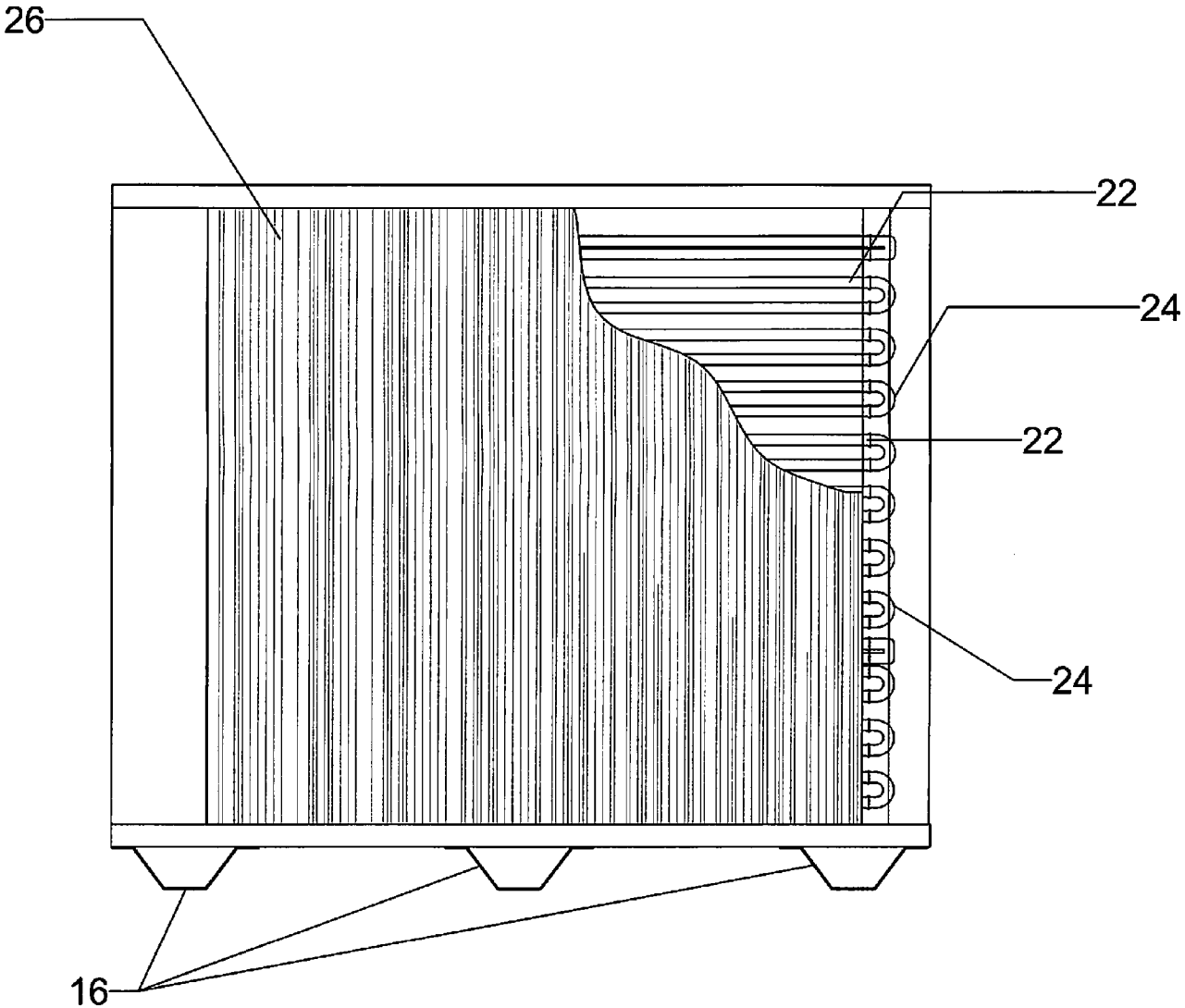
FIG. 2 hereof is a front view of the condensing unit of the present invention showing condenser coils, heat transfer fins, and runners.

The condensing unit of the present invention contains a condenser coil assembly 18 that is vertically disposed and secured at said first end 12 of said base plate 10. The condenser coil assembly, which occupies most of the front of the condenser unit, is framed-in so that substantially all of the air drawn into the condenser unit by operation of the fan assembly must pass through the condenser coil and fins. It is preferred that a gasket (not shown) be provided between the perimeter of the condenser coil assembly and the front panel. Condenser coil assemblies are well known in the art and are typically comprised of two opposing header plates 20 that are also sometimes referred to as tube sheets, through which refrigerant carrying tubes, or coils (22 of FIG. 2), extend across the width of the condenser coil assembly. The ends of the tubes are interconnected by return bends 24 so that a continuous loop, of a serpentine shape, forms the condenser coil. There is a predetermined spacing between each horizontally disposed coil section. A large number of vertically disposed closely spaced fins 26 (FIG. 2 hereof), typically formed of a thin metallic material such as aluminum, are penetrated by the coil tubes to assist in heat transfer.

The number of fins per linear inch of tubing for conventional condensing units is typically from about 20 to 25 fins per linear inch on ⅜ inch outside diameter tubing. In a hostile environment, such as in a marine environment, particularly on crew and supply boat, such spacing leads to plugging from things such as salt spray to particulate matter. This in turn leads to premature compressor failure and increased maintenance cost and down time for the vessel and crew. The number of fins per linear inch for the condensing units of the present invention is from about 8 to 19 fins per linear inch, preferably from about 10 to 18, more preferably from about 12 to 18, and most preferably from about 14 to 16 per linear inch. It is preferred that the tubing carrying the refrigerant for the condenser units of the present invention have an outside diameter of about 0.5 inch. These fins per linear inch correspond to spacing between fins of about 0.080 to about 0.050 inches preferably from about 0.070 to about 0.060 inches. The fins used on the condenser coil of the present invention will be from about 0.0050 to about 0.0060 inches thick. It is preferred for 0.5 inch diameter tubing that the fins have an average thickness of about 0.0060 inches. Of course a balance must be struck between the surface area needed to provide adequate heat transfer and the distance between fins needed to prevent significant premature clogging of the fins.

The corrosion resistance of the condenser coil assembly of the present invention is improved by coating the entire assembly (coil, fins, and refrigerant inlet and outlet manifolds) with a suitable corrosion inhibitor. It if preferred that the assembly be coated by a dipping method wherein the entire assembly is dipped into a bath of suitable corrosion inhibitor. It is also preferred that the coated surface be substantially hydrophilic to mitigate bridging between fins, which is typically caused by the condensation of water droplets on the surface of the fins. One method that can be used to create a hydrophilic coated surface is described in U.S. Pat. No. 4,671,825 which incorporated herein by reference. This '825 patent discloses a method for forming a hydrophilic corrosion-resistant coating on the surface of a metallic material, which method comprises preparatorily cleaning the surface of the metallic material. The cleaned surface is treated with an aqueous treating liquid produced by adding a water-soluble acrylic acid polymer and colloidal silica and selected amounts of polyhydric alcohols and/or saccharides to an aqueous solution containing hexavalent chromium compound or trivalent and hexavalent chromium compounds, phosphoric acid, and a fluorine compound. The treated surfaces are dried of the treating liquid, then baked at a baking temperature in the range of about 100° to about 250° C. A more preferred corrosive resistant coating is one provided by ElectrFin Inc. having offices in Louisville, Ky. wherein a flexible epoxy coating is substantially uniformly applied to all coil surface areas without material bridging between fins. This coating process ensures substantially complete coil capsulation and a substantially uniform dry film thickness from about 0.8 to about 1.2 mil thick on all surfaces, including fin edges.

Returning now to FIG. 1 hereof, the condensing unit of the present invention will also contain a fan assembly comprised of fan blade 30 and a motor 32 for rotating fan blade 30. The fan assembly is secured to a fan assembly support bracket 28 that in-turn secured to the rear panel, or plate 31, of the condenser unit. The rear panel contains a discharge port 29 extending into the interior of the condenser unit to form a cylindrical walled shroud for the fan assembly. Shroud 29 will extend past the fan blades but not so far into the condenser unit as to cause any undesirable results or to interfere with any components within the condenser unit. It is preferred that the cylindrical shroud be formed as a continuous and integral shape from the rear panel material, preferably a stainless steel sheet meal, that is formed by any suitable means, such as by a stamping or pressing operation. There will be a gap 34 between the inside cylindrical wall of the shroud and the fan blade. This gap will be from about 0.100 inch to about 0.900 inch, preferably from about 0.125 inch to about 0.875 inch, more preferably from about 0.125 inch to about 0.625 inch. Fan assembly supporting bracket 28 is preferably constructed so that there be a notch, or lip 35, that fits against the cylindrical wall of the shroud to provide additional support and stability for the bracket 28 and fan assembly. There is also provided a fan guard 37 that is positioned over, but not in contact with, said support bracket 28. Fan guards are well known in the art and thus no further discussion is needed for an understanding to the present invention. It will be understood that the fan assembly supporting bracket can be eliminated and the fan assembly secured to the fan guard instead. Although this will be functional it is not preferred because extended use can cause an undesirable amount of vibration and at some point cause the fan to contact the shroud.

Fan blade 30 is oriented so that during operation, a stream of air is drawn through said condenser coil assembly 18, through the shroud and out of discharge port 29 which is part of the rear panel. Conventional condensing units typically vertically discharge air that is passed through a condenser coil assembly. Discharging air vertically within the confines of another deck would cause the heated condensing air to be re-circulated and drawn back into the condenser coils, causing the unit to operate at an undesirable high temperature and pressure. This would lead to diminished capacity of the condensing unit. Also, vertical discharge would require more space when multiple units are required because they would have to be placed side-by-side and a certain minimum distance needs to be provided between units to allow for service and adequate air flow. The condensing units of the present invention discharge air horizontally so that multiple condensing units can be stacked on one another to conserve valuable deck space. Also, the condensing units of the present invention, for the most part, are enclosed with corrosive resistant panels, such as stainless steel panels of sheet metal of an effective thickness so that at least two additional condensing units can be stacked thereon.

The condensing unit of the present invention also contains a compressor 36 suitable for compressing a refrigerant. The compression of the refrigerant results in refrigerant being heated. The heated refrigerant is then sent through the condenser coils where a substantial amount of heat is dissipated through the fins. The compressor can be any type of compressor of suitable size for the overall air conditioning system and can be of the reciprocating piston type, the scroll type or any other type suitable for compressing a refrigerant used in an air conditioning system.

A water tight electrical enclosure 38 is also provided wherein electrical leads such as the electrical leads 40 which provide power to electrical components of the condensing unit such as the fan assembly and compressor 36. Electrical connections are also provided for a controller and main (field) power within the electrical enclosure. It is preferred that the electrical enclosure be comprised of a corrosion resistant material such as a polymeric composite material or stainless steel.

Figure 3:
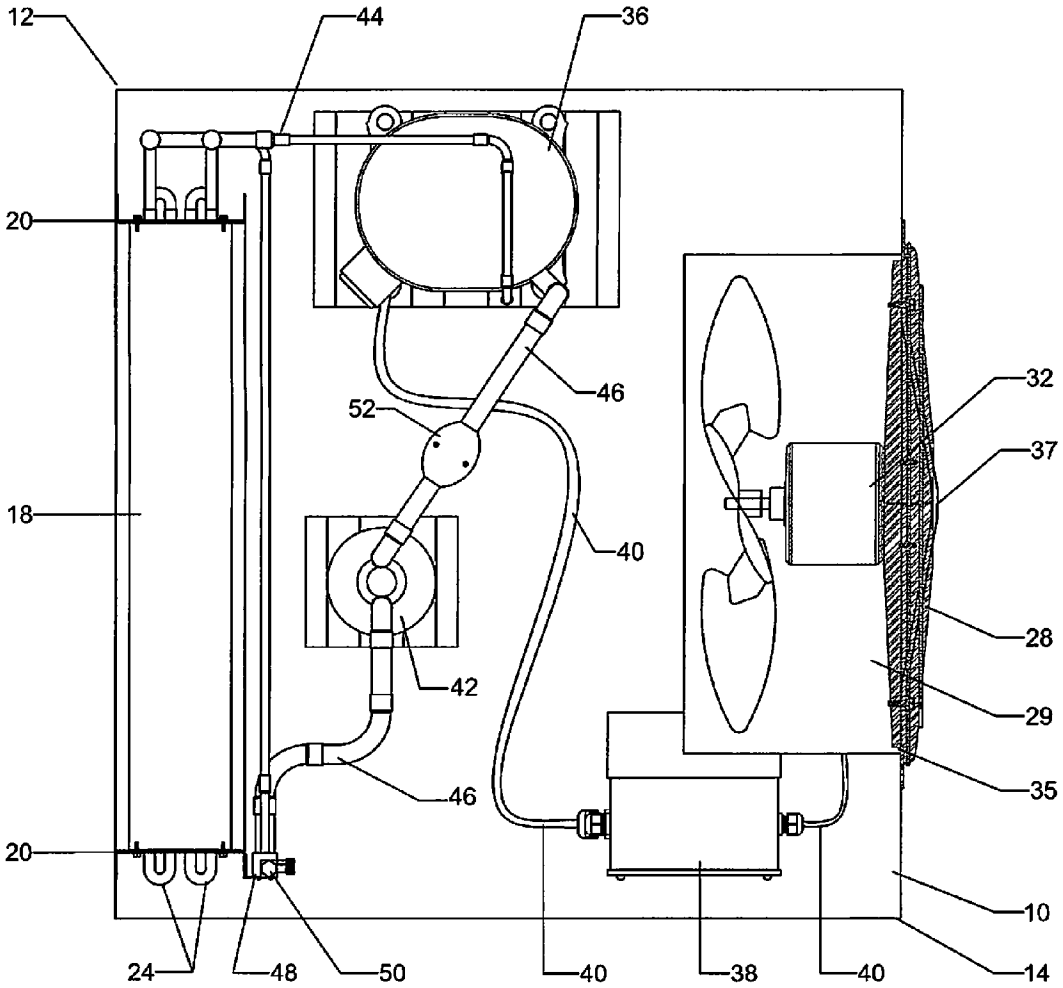
FIG. 3 hereof is a top view of the condensing unit of the present invention.

FIG. 3 hereof is a top view of the interior of the condensing unit of FIG. 1 hereof. The condensing unit of the present invention is designed to be used in a closed loop air conditioning system. Closed-loop air conditioning systems conventionally employ a compressor that draws in gaseous refrigerant at relatively low pressure and discharges hot refrigerant at relatively high pressure. The hot refrigerant condenses into liquid as it is cooled in the condenser. A small orifice or valve divides the system into high-pressure and low-pressure sides. The liquid on the high-pressure side passes through the orifice or valve and turns into a gas in the evaporator (not shown) as it picks up heat. At low heat loads it is not desirable or possible to evaporate all the liquid. However, liquid refrigerant entering the compressor (known as "slugging" or "carryover") causes system efficiency loss and can cause damage to the compressor. Hence an accumulator (suction accumulator) 42 is provided between the evaporator and the compressor to separate and store the excess liquid. The suction accumulator 42 is typically a metal can, welded together, and often has fittings attached for a switch and/or charge port. One or more inlet tubes and one or more outlet tube pierce the top, sides, or occasionally the bottom, or attach to fittings provided for that purpose. The refrigerant flowing into a typical accumulator will impinge upon a deflector or baffle intended to reduce the likelihood of liquid flowing out the exit. FIG. 3 also shows high pressure line 44 which passes hot refrigerant gas to the condenser coil 18. There is also shown low pressure lines 46 that receives refrigerant from one or more evaporators (not shown) which pass though the suction accumulator 42 to compressor 36. Also shown is a suction service valve 48 and liquid service valve 50, both of which are well known in the refrigeration and air conditioning art.

It is also within the scope of this invention that a sacrificial anode 52 be used at one or more locations on the condensing unit of the present invention. A preferred location would be to encase a section of the tubing from the compressor to the condenser coil with a sacrificial anode. A sacrificial anode is a metallic anode used in cathodic protection to protect other metals from corrosion. The more active metal corrodes first (hence the term "sacrificial) and generally must oxidize nearly completely before the less active metal (copper tubing) will corrode, thus acting as a barrier against corrosion for the protected metal. One particularly preferred sacrificial anode is the one provided by A/C Zincs, Inc and available under the tradename "The Corrosion Grenade". Such an anode protects against galvanic corrosion that occurs whenever two dissimilar metals, electrical power, and an electrolyte (salt) are present. Aluminum, the softest metal in the condensing unit, begins to deteriorate as soon as the system is started. Use of a sacrificial anode will prolong the life of the condenser coil assembly.

Figure 4:
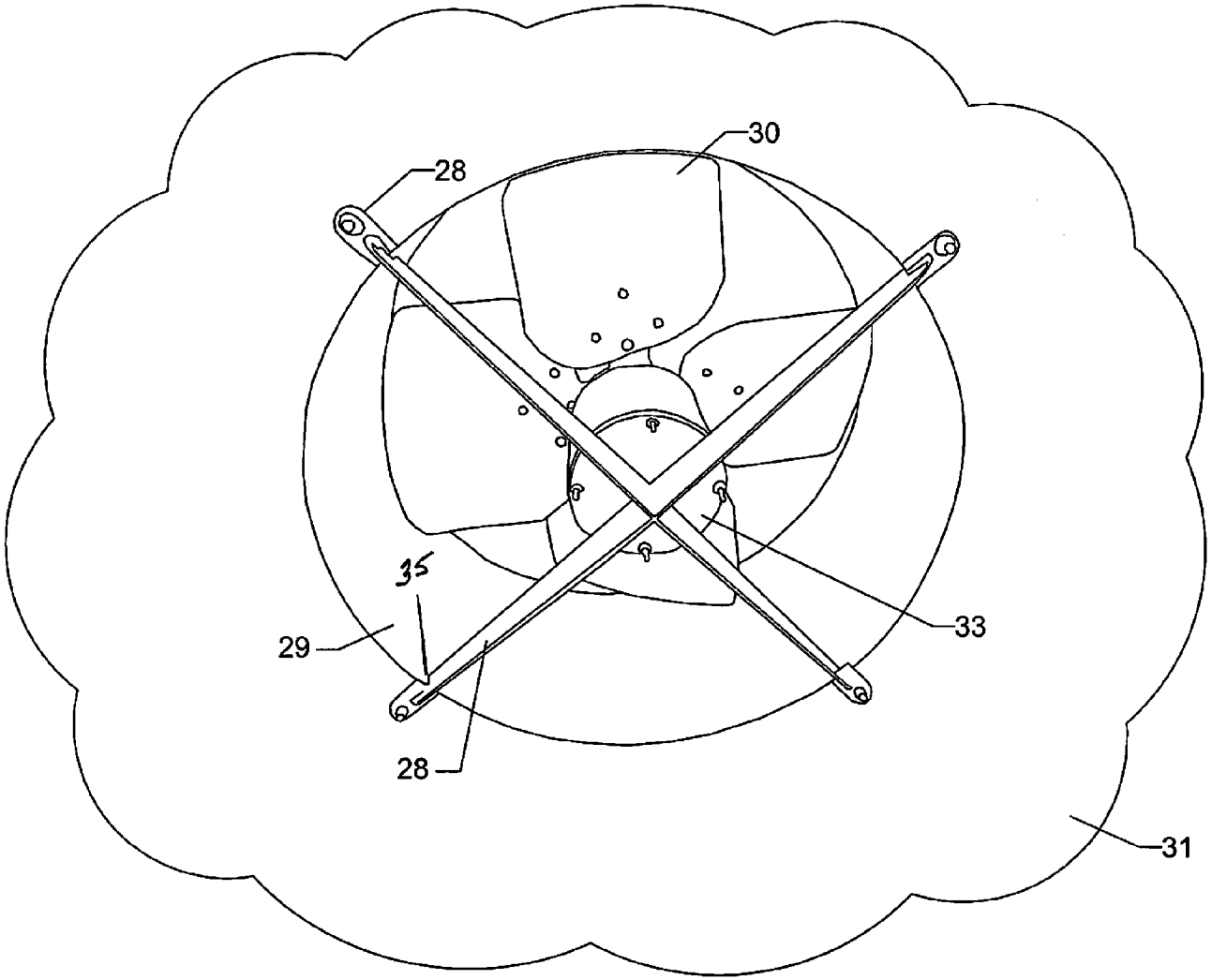
FIG. 4 hereof is an elevated view of the discharge port which is an integral part of the rear panel of the condensing unit of present invention showing the fan assembly attached to a supporting bracket that is secured to the rear panel of said condensing unit.

FIG. 4 hereof is a representation of the section of the rear panel of the condensing unit of the present invention containing discharge port 29. This figure shows the fan assembly centered in the discharge port defined by shroud 29 and attached to supporting bracket 28 by fan motor 32. The supporting bracket is secured to rear panel 31 of the condensing unit. Any suitable supporting bracket can be used in the practice of the present invention as long as it securely holds the fan in position within the shroud. The preferred embodiment shown in this FIG. 4 shows a the fan motor 32 secured by screws or bolts to a center plate 33 of the supporting bracket, which in this figure has four legs or arms, although any suitable number can be used.

Figure 5:
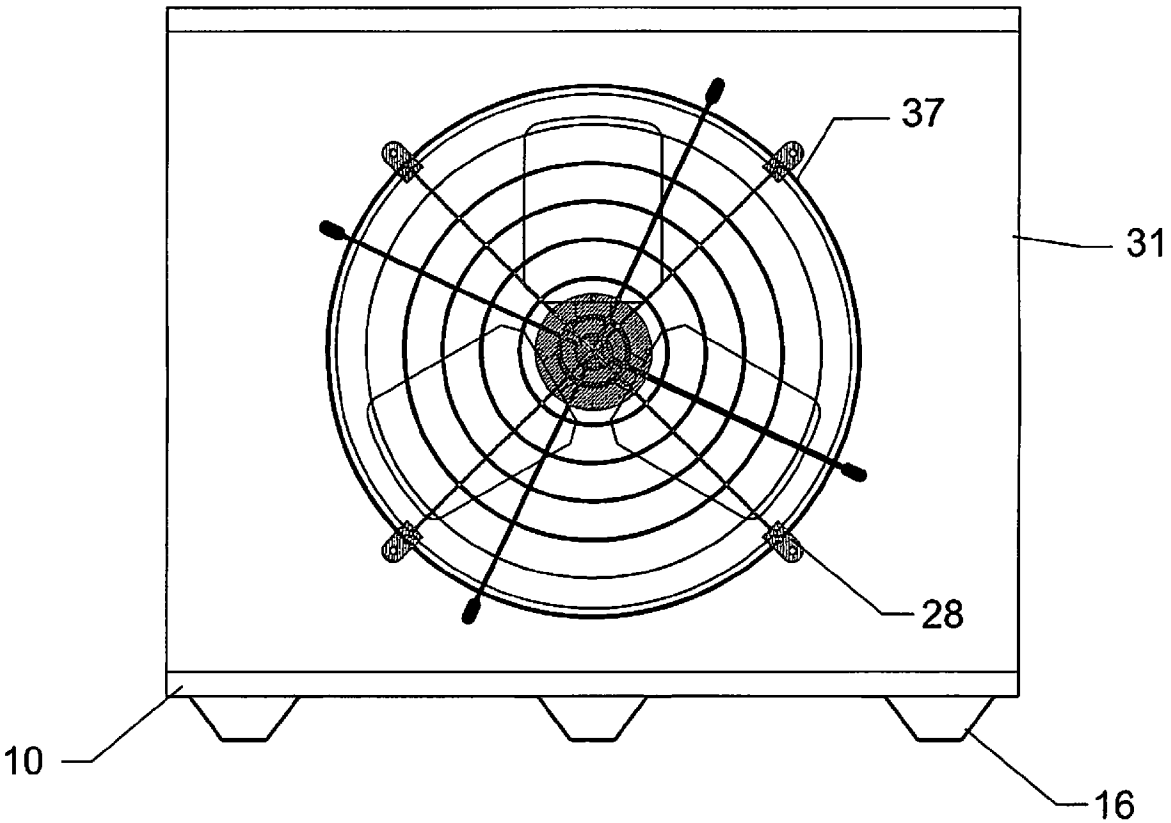
FIG. 5 hereof is a rear view of the condenser unit of the present invention showing a fan guard positioned over the fan assembly support bracket, both of which are secured to the outside surface of said rear panel of the condensing unit.

FIG. 5 hereof is a view of the rear of the condenser unit of the present invention showing exhaust port 29, the fan assembly secured to the supporting bracket 28 and a fan guard 37 position over, but not in contact with, supporting bracket 28.

Figure 6:
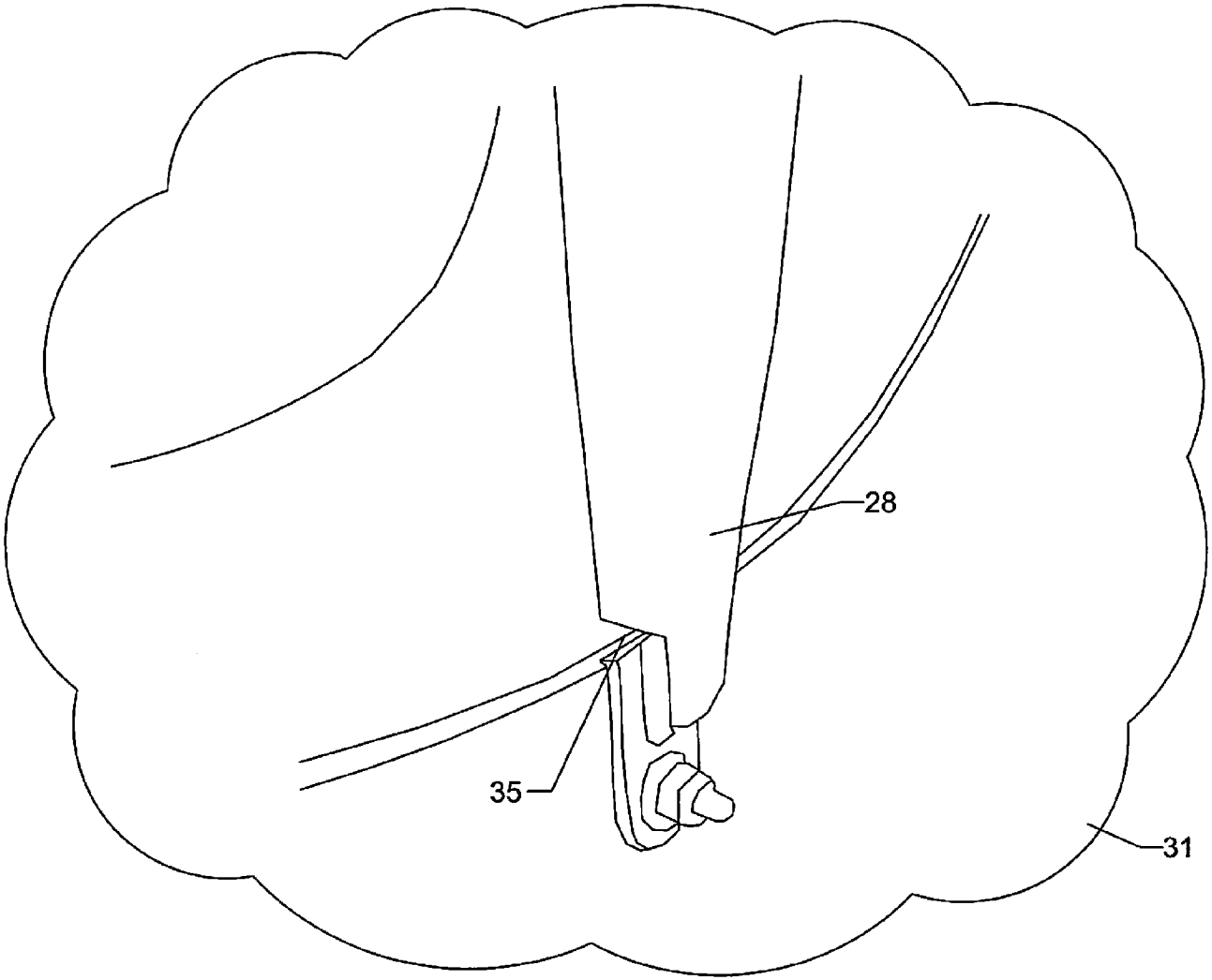
FIG. 6 hereof is a blown-up view of how the fan assembly support bracket is secured to the rear panel of the condensing unit of the present invention.

FIG. 6 hereof is a blown-up view of a preferred are of attachment for the fan assembly supporting bracket 28. This figure shows notch, or lip 35. Bracket 28 can be secured to rear panel 31 by any suitable securing means, such as by use of a nut and bolt.

What is claimed is:

1. A condensing unit for use with an air conditioning system, the condensing unit is associated with a marine vessel and is resistant to salt water corrosion, the condensing unit is comprised of: a) a housing comprised of a corrosion resistant substantially flat baseplate having a first end and a second end and containing at least one drain hole, two corrosion resistant opposing side panels, a corrosion resistant top panel and a corrosion resistant rear panel, the rear panel contains a discharge port extending into the interior of the condensing unit and forming a shroud; b) a condenser coil assembly coated with a material that is resistant to corrosion with respect to a salt water environment and operatively secured to said first end of said baseplate, the condenser coil assembly being comprised of opposing vertically disposed header plates and through the header plates horizontally disposed refrigerant carrying tubing extend across the width of said condenser coil assembly and wherein the ends of said tubes are interconnected by return tube bends to form a continuous loop, and wherein there is provided a plurality of vertically disposed metallic fins penetrated by said horizontally disposed tubing wherein the number of fins per linear inch is from 8 to 19 to mitigate plugging between fins; c) a fan assembly comprised of a fan blade and a fan motor for rotating said fan blade, wherein the fan assembly is secured at said second end of said baseplate by use of a supporting bracket that is secured to the rear panel of said condenser unit and said fan motor is attached to the condenser unit, wherein the fan assembly and condenser coil assembly are oriented so that a stream of air is drawn through said condenser coil assembly by operation of said fan blade and discharged horizontally with respect to the deck of the marine vessel through said discharge port at the rear panel; d) a corrosion resistant shroud surrounding said fan assembly, wherein there is a gap between the outermost edge of said fan blade and the interior wall of said shroud, which gap is between about 0.100 inch to 0.900 inch; e) a compressor operatively connected to said condenser coil and positioned between said fan assembly and said condenser coil assembly, which compressor is capable of compressing and moving a refrigerant through said condenser coil; and f) a corrosive resistant substantially water tight electrical enclosure wherein the main power, controller connections, and electrical components of said condensing unit are connected.

2. The condensing unit of claim 1 wherein the baseplate is comprised of stainless steel.

3. The condensing unit of claim 2 wherein the stainless steel is a 316 grade stainless steel.

4. The condensing unit of claim 1 wherein the coating applied to said condenser coil assembly is from about 0.8 to about 1.2 mils thick.

5. The condensing unit of claim 4 wherein the coating is an epoxy coating.

6. The condensing unit of claim 1 wherein the gap between the shroud and the fan blade is from about 0.125 inch to about 0.875 inch.

7. The condensing unit of claim 1 wherein the gap between the shroud and the fan blade is from about 0.125 inch to about 0.625 inch.

8. The condensing unit of claim 1 wherein there is provided a sacrificial anode on the high pressure line between the compressor and the condenser coil assembly, the low pressure line from an evaporator to the compressor, or both.

9. The condensing unit of claim 8 wherein the sacrificial anode is a zinc containing material.

10. The condensing unit of claim 1 wherein there is provided a suction accumulator between evaporator and the compressor.

11. The condensing unit of claim 1 wherein the number of fins per linear inch of tubing is from about 10 to 18.

12. The condensing unit of claim 1 wherein the number of fins per linear inch of tubing is from about 12 to 18.

13. The condensing unit of claim 1 wherein the outside diameter of said refrigerant carrying tubing is about 0.5 inch.

* * * * *